US011760536B2

(12) United States Patent
Weis

(10) Patent No.: US 11,760,536 B2
(45) Date of Patent: Sep. 19, 2023

(54) HYGIENIC PALLET AND METHODS OF USE AND MANUFACTURE

(71) Applicant: THE HERSHEY COMPANY, Hershey, PA (US)

(72) Inventor: Steven A. Weis, Hershey, PA (US)

(73) Assignee: The Hershey Company, Hershey, PA (US)

( * ) Notice: Subject to any disclaimer, the term of this patent is extended or adjusted under 35 U.S.C. 154(b) by 0 days.

(21) Appl. No.: 17/497,179

(22) Filed: Oct. 8, 2021

(65) Prior Publication Data

US 2023/0110211 A1 Apr. 13, 2023

(51) Int. Cl.

*B65D 19/38* (2006.01)
*B65D 85/72* (2006.01)
*B65D 19/00* (2006.01)

(52) U.S. Cl.

CPC ..... *B65D 19/38* (2013.01); *B65D 19/0079* (2013.01); *B65D 85/72* (2013.01);
(Continued)

(58) Field of Classification Search

CPC .... B65D 19/38; B65D 19/44; B65D 19/0079; B65D 2519/00039; B65D 2519/00825;
(Continued)

(56) References Cited

U.S. PATENT DOCUMENTS 3,962,660 A * 6/1976 Duckett ..... H02B 7/06 248/346.02
3,993,168 A * 11/1976 Kubick ..... B65D 19/0034 108/55.3
(Continued)

FOREIGN PATENT DOCUMENTS

WO 8705580 A1 9/1987
WO 9410051 A1 5/1994
(Continued)

OTHER PUBLICATIONS

Reusable Transport Packaging; Rackable Plastic Pallet; webpage; 9 pages; retrieved Jan. 27, 2022 <https://reusabletranspack.com/?s=rackable+plastic+pallet>.
(Continued)

*Primary Examiner* — Jose V Chen
(74) *Attorney, Agent, or Firm* — SHOOK, HARDY & BACON L.L.P.

(57) ABSTRACT

A hygienic pallet suitable for use in food manufacturing is formed of a food-grade material. The pallet comprises a load supporting surface extending between pallet edges. The pallet also comprises support lips that extend upward and away from the load supporting surface and in a direction away from a pallet edge. At least two support lips can be separated to form a channel between chamfered edges of the support lips. The support lips support molds or other objects on the load supporting surface during movement of the pallet, while the channels facilitate removal of debris and liquid during use or cleaning of the pallet. The pallet further comprises a section divider that divides stacking sections of the load supporting surface. Stackable molds for food manufacturing can be placed within the stacking areas to transport the mold stacks. A method of manufacturing the hygienic pallet comprises rotational molding.

19 Claims, 5 Drawing Sheets

(52) U.S. Cl.
CPC ..... *B65D 2519/00034* (2013.01); *B65D 2519/0086* (2013.01); *B65D 2519/00825* (2013.01)

(58) Field of Classification Search
CPC .. B65D 2519/0086; B65D 2519/00935; B65D 85/72
USPC ..... 108/51.11, 55.1, 55.3, 53.1, 53.3, 57.25, 108/57.28
See application file for complete search history.

(56) References Cited

U.S. PATENT DOCUMENTS 3,995,749 A * 12/1976 Haskins ..... B65D 19/44 206/821
D246,296 S 11/1977 Fujii et al.
D256,904 S 9/1980 Persson
4,226,192 A * 10/1980 Myers ..... B65D 19/0018 108/55.3
4,230,051 A * 10/1980 Mays ..... B65D 19/0095 108/55.3
D272,573 S 2/1984 Degironemo
4,516,677 A * 5/1985 Rowland ..... B65D 71/70 108/55.3
D283,267 S 4/1986 Kero et al.
4,898,321 A * 2/1990 Delany ..... B65D 19/20 206/599
5,052,307 A * 10/1991 Morrison ..... B65D 19/38 108/55.3
5,080,023 A * 1/1992 Miura ..... B65D 19/44 108/55.3
5,144,897 A * 9/1992 Avery ..... B65D 71/70 108/55.3
5,413,054 A * 5/1995 Collins ..... B65D 19/44 108/55.3
5,497,708 A * 3/1996 Jeruzal ..... B65D 19/44 108/55.3
5,606,921 A 3/1997 Elder et al.
5,687,652 A 11/1997 Ruma
5,769,376 A * 6/1998 Bostic ..... B65D 81/261 248/346.02
5,778,801 A 7/1998 Delacour
5,791,262 A 8/1998 Knight et al.
D399,631 S 10/1998 Campbell
5,970,886 A * 10/1999 Knio ..... B65D 19/38 108/57.12
D428,679 S 7/2000 Bridge
6,101,955 A 8/2000 Salce
6,112,672 A * 9/2000 Heil ..... B65D 19/0095 108/55.3
6,142,440 A * 11/2000 Gratz ..... A47F 7/17 108/51.11
6,199,488 B1 3/2001 Favaron et al.
6,558,093 B1 * 5/2003 Arnold ..... B65D 19/0077 108/55.3
6,938,558 B1 9/2005 Peres
6,955,129 B2 10/2005 Moore, Jr. et al.
7,918,165 B2 * 4/2011 Owen ..... B65D 19/385 108/55.3
8,127,691 B2 3/2012 Ingham
D661,453 S 6/2012 Kelly et al.
8,701,571 B2 4/2014 Grant
9,988,180 B2 6/2018 Ogburn
10,689,153 B2 6/2020 Segerstrom
2002/0078863 A1 6/2002 Marr et al.
2002/0195027 A1 * 12/2002 Malian ..... B65D 19/44 108/55.3
2006/0201402 A1 9/2006 Moore, Jr. et al.
2006/0272556 A1 * 12/2006 Apps ..... B65D 19/004 108/53.1
2007/0068427 A1 * 3/2007 Burke ..... A47F 1/126 108/55.3
2007/0137533 A1 6/2007 Carson et al.
2010/0288169 A1 11/2010 Du Toit
2011/0005433 A1 * 1/2011 Pichereau ..... B65D 19/0016 248/346.02
2011/0120353 A1 5/2011 Jensen et al.
2012/0325125 A1 * 12/2012 Apps ..... B65D 19/0014 108/51.11
2013/0014676 A1 1/2013 Imbrecht et al.
2014/0033956 A1 * 2/2014 Kelly ..... B65D 85/302 108/55.3
2015/0336709 A1 * 11/2015 Hsiao ..... B65D 19/44 206/386
2016/0114936 A1 * 4/2016 Muirhead ..... B65D 19/0012 108/57.25
2016/0251114 A1 * 9/2016 Lee ..... B65D 85/06 108/55.3
2016/0318656 A1 11/2016 Takyar et al.
2017/0001755 A1 * 1/2017 Clark ..... B65D 19/44

FOREIGN PATENT DOCUMENTS

WO 9609216 A1 3/1996
WO 2017137874 A1 8/2017

OTHER PUBLICATIONS

Snyder Industries; Snyder double sided plastic pallet; webpage; 8 pages; Apr. 15, 2019 <https://shop.snydernet.com/pallets/double-sided.asp>.
Cabka; Cabka IPS Hygienic Plastic Pallets; webpage; 8 pages; Aug. 17, 2015 <https://cabka.com/en-us>.
Daco; Sani-Pallet 3000—40x48 Plastic Pallets—Food Grade; webpage; 3 pages; retrieved Jan. 27, 2022 <https://www.dacocorp.com/sani-pallet-3000-40x48-plastic-pallets-food-grade>.
Qingdao Enlightening Electromechanical Co., Ltd., Durable solid deck 1200×1000×150 hygienic/hygene food grade euro plastic pallet/palette plastique/tarimas de plasticot; webpage; 8 pages; retrieved Jan. 27, 2022 <https://www.alibaba.com/product-detail/Durable-solid-deck-1200x1000x150-hygienic-hygene_60667448565.html?spm=a2700.pc_countrysearch.main07.29.118d631bcLjab0>.
International Search Report and Written Opinion received for PCT Application No. PCT/US2022/39839, dated Nov. 1, 2022, 11 pages.

* cited by examiner

HYGIENIC PALLET AND METHODS OF USE AND MANUFACTURE

BACKGROUND

In commercial food and beverage manufacturing, manufacturers adhere to high standards of hygiene. Further, many manufacturers manufacture products in large quantities. Large quantities of some products are heavy, and manufacturers use machines to transport such quantities. Many machines, such as forklifts or conveyors, use pallets to assist in transportation by stacking products on the pallet and then maneuvering the pallet with the products to a particular location. During use, a pallet might become dirty from debris particles that accumulate onto the pallet from the food products being transported. As a result, the pallet could require cleaning prior to its next use.

SUMMARY

At a high level, aspects of the technology relate to hygienic pallet designs. One example provides a pallet formed of a food-grade polymer material. The pallet comprises a load supporting surface on which molds can be placed or stacked for transportation. The pallet also comprises support lips that support a mold or mold stack from moving off a pallet edge during transportation. The support lips extend upward and away from the load supporting surface and away from the pallet edge.

The pallet can have at least two support lips that are separated. The separation of the support lips forms a channel that extends to the pallet edge. Channel walls are comprised of chamfered edges of the support lips, and a base of the channel is a planar extension of the load supporting surface. The channels help facilitate the movement of liquid and debris off of a pallet, thus reducing the drying time and reducing the amount of liquid cleaning agent that is needed to clean the pallet, since debris particles are more easily moved off the pallet during cleaning.

The molds or mold stacks placed onto the load supporting surface can be placed within stacking sections, which are areas or portions of the load supporting surface. The stacking sections can be defined by and separated by section dividers. The section dividers of the pallet may also be formed such that they extend upward and away from the load supporting surface, and they may be positioned perpendicular to the support lips at locations corresponding to channels, which helps to facilitate movement of debris and liquid through the channels.

This summary is intended to introduce a selection of concepts in a simplified form that is further described by this disclosure. The summary is not intended to identify key or essential features of the claimed subject matter, nor is it intended to be an aid in determining the scope of the claimed subject matter. Additional objects, advantages, and novel features of the technology will provided in part in the description that follows, and in part will become apparent to those skilled in the art upon examination of the disclosure or learned through practice of the technology.

BRIEF DESCRIPTION OF THE DRAWINGS

The present technology is described in detail below with reference to the attached drawing figures, wherein.

DETAILED DESCRIPTION

Figure 1:
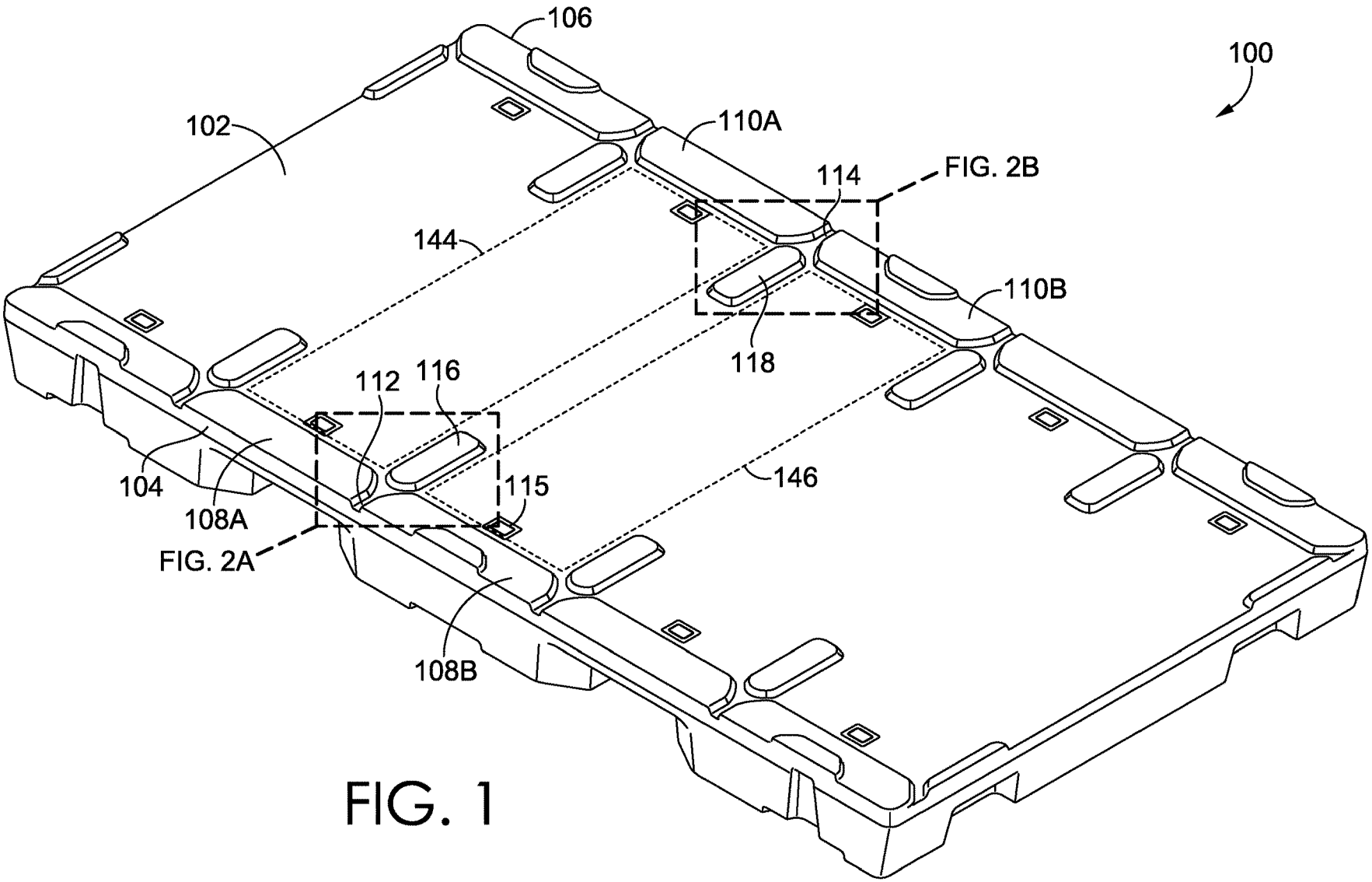
FIG. 1 is a top perspective view of a pallet, in accordance with an aspect described herein.

Hygienic pallets suitable for use in food manufacturing industries, including pallets that can be used in manufacturing confectionaries, are provided by this disclosure. Methods for using the pallets and methods for manufacturing the pallets are also provided.

As noted in the background section, food manufacturers adhere to strict levels of hygiene when manufacturing food products, including confectionaries like chocolates and candies. Such hygiene standards are adhered to during all parts of the manufacturing process, including transporting large quantities of food product within a facility.

When transporting heavy loads, which typically result from such large quantities, manufacturers often use pallets that can be maneuvered by machinery, such as forklifts or conveyor systems. Thus, there is even a need within the industry to have pallets that maintain the desired high level of hygiene.

The present disclosure provides for pallets that improve upon the already high standard of hygiene maintained by many manufacturers. One example pallet that offers improved hygiene for use in food manufacturing facilities, among other potential uses, includes a pallet formed of a polymer and having an internal rigid framework that provides additional support for the pallet.

The pallet can have a load supporting surface that is the surface on which a load rests when it is being transported by the pallet. The load supporting surface of the pallet can have stacking sections, which may be areas or locations of the load supporting surface where objects, such as a confectionary or chocolate mold, may rest. For instance, the load supporting surface can be divided into a plurality of stacking sections where a mold or mold stack can be placed. By dividing the load supporting surface into stacking sections, higher numbers of molds can be placed or stacked, increasing the quantity of goods that can be transported and increasing the efficiency of the supply chain process.

The stacking sections can be delineated by section dividers and support lips provided by the pallet. As will be illustrated, the pallet has pallet edges that form the overall shape of the pallet. The support lips can be positioned along the edges, and extend upward from the load supporting surface and away from one of the pallet edges. The support lips help provide support to a mold on the load supporting surface so that the mold does not move about during transportation and slide off the pallet edge. The section dividers can also extend upward and away from the load supporting surface, and can be positioned so that they extend across a portion of the load supporting surface, thereby separating the load supporting surface into stacking sections where molds may be stacked. In some pallet designs, the support lips, the section dividers, and the load supporting surface are formed from one integrated piece of material, such as a polymer, including food-grade polymers, or another food-grade material, such as stainless steel. This helps facilitate washing the pallet because it reduces or eliminates areas where debris, such as food or other contamination, might accumulate. It also facilitates drying time, since there are fewer to no places where water can accumulate on the pallet.

To further enhance washing and drying the pallet, which many manufacturers perform before or after use of the pallet, the pallet can include one or more channels that facilitate the flow of liquid and debris away from the load supporting surface to the pallet edge. A channel can be formed from two or more support lips. That is, two support lips can be separated, e.g., having a separation between the two support lips. The channel can be formed from the separation. For instance, a portion of each of the separated support lips forms a channel wall of the channel. Put another way, each support lip comprises a support lip perimeter edge around the support lip, and the support lip perimeter edge of a first support lip can be separated from the support lip perimeter edge of the second support lip. The base of the channel can be formed from an extension of the load supporting surface that is between support lips. The channel may extend from the pallet edge inward or toward the opposite pallet edge.

In some designs, a portion of the support lip that forms the channel wall comprises a chamfered edge. Chamfered edges may be located along the support lip perimeter edges opposite that of the pallet edge from which the support lip extends. In this way, the channel may have a channel opening that is larger than another channel opening of the same channel. Here, a first channel opening may be adjacent to the pallet edge and can generally be described as an egress channel where a liquid would generally exit the channel and off of the pallet edge. The opposite channel opening of the same channel, e.g., a second channel opening that opens toward the opposite pallet edge and that can generally be described as an ingress channel opening where liquid can enter the channel, is larger due to the chamfered edges of the support lips. This aids further aids in the removal of liquids from the load supporting surface of the pallet by directing the flow of the liquid away from the load supporting surface toward and off the pallet edge.

The section dividers of the pallet can be positioned relative to the channels. For instance, a midline of the section divider, i.e., a section divider midline, can be aligned with a midline of the channel, i.e., a channel midline. In this way, liquid on the pallet from a cleaning process, or other debris or liquid exposed to the load supporting surface when using the pallet, is directed toward the channel opening and toward the pallet edge by the section dividers.

When manufacturing a pallet with these benefits, a polymer can be formed within a rigid frame. The polymer can include a non-porous, food-grade material, such as polyethylene. For example, a rigid frame may be positioned within a pallet mold. A rotational molding process can be used to deposit a non-porous, food-grade material, such as polyethylene, around the rigid frame while the rigid frame is positioned within the pallet mold. Once removed from the pallet mold, the resulting pallet encases the rigid frame and comprises features corresponding to features of the pallet mold. Other food-grade materials, including metals are contemplated and may be used. This provides the pallet with sufficient rigidity and increases its load capacity, while at the same time, providing for external food-grade material and reducing the overall weight of the pallet as compared to another design that might only have a surface coating of material.

In operation, the pallets can be used to move stacked molds that contain confectionaries or other objects. Any debris that lands on the pallet during operation or cleaning is efficiently moved off the pallet due to the design of the section dividers and the support lips that form the channel. The pallet can be used by placing a base mold onto a stacking section that is defined by the section dividers and the support lips, and since a pallet may contain multiple stacking sections, multiple base molds may be placed onto the load supporting surface within the stacking sections. When using stackable molds, additional molds can rest on the base mold. In this way, the pallet can carry a large number of molds by providing support to a base mold so that it does not readily slide around during movement, helping to prevent tipping of molds stacked onto the base mold.

It will be realized that the pallet previously described is only an example that can be manufactured and used based on the description that follows, and it is provided as an example to more easily understand the technology and to better recognize its benefits. Additional examples will be described with reference to the figures.

When referencing the figures and throughout the discussion generally, certain positional terms may be used, such as "up," "down," "top," and "bottom." These positional words, among others, are intended to refer to a pallet when the pallet is resting in a flat position with its load supporting surface opposite a surface on which the pallet is resting. Put in terms of a coordinate system, in this position, the load supporting surface extends along a plane created by an x-axis and a z-axis, while a y-axes extends vertical and perpendicular through the plane of the x- and z-axes.

Turning now to FIG. 1, FIG. 1 is a top perspective view of example pallet 100. Pallet 100 comprises load supporting surface 102. Load supporting surface 102 extends from first pallet edge 104 to second pallet edge 106. That is, load supporting surface 102 may extend from first pallet edge 104 along the z-axis to second pallet edge 106.

As illustrated in FIG. 1, first pallet edge 104 is parallel with and separated apart from second pallet edge 106 by load supporting surface 102. A portion of load supporting surface 102 may terminate at a location corresponding to first pallet edge 104, while another portion of load supporting surface 102 may terminate at a location corresponding to second pallet edge 106. Second pallet edge 106 is opposite first pallet edge 104, and load supporting surface 102 extends at least partially between first pallet edge 104 and second pallet edge 106. First pallet edge 104 and second pallet edge 106, or any other pallet edges, or any portion thereof, may coincide with terminal edges of pallet 100, such as in the illustration provided by FIG. 1. In some cases, first pallet edge 104 and second pallet edge 106 may coincide with a terminal edge of a portion of load supporting surface 102, and pallet 100 may have other edges that extend beyond first pallet edge 104 and second pallet edge 106.

Pallet 100 may comprise any number of support lips. Pallet 100, as illustrated in FIG. 1, comprises at least two support lips, first support lip 108A and second support lip 108B. Each of first support lip 108A and second support lip 108B extends upward and away from load supporting surface 102. Said differently, each of first support lip 108A and second support lip 108B extend upward and away from load support surface 102 along the y-axis. Each of first support lip 108A and second support lip 108B extends in a direction from first pallet edge 104 toward second pallet edge 106.

In general, support lips may be positioned coincident with a pallet edge, such as first pallet edge 104 of pallet 100. Here, support lips aid in positioning a load onto the pallet, such as how a load would be positioned on load supporting surface 102 of pallet 100. Moreover, the position of some support lips aids during transportation of a load. Since a load experiences force during transportation, the support lips help keep the load from moving about a pallet. This is particularly beneficial in keeping a load from moving off a terminal edge of the pallet. As such, pallet designs comprising support lip configurations can be used to carry larger and heavier loads in a safer manner.

As illustrated by FIG. 1, pallet 100 also comprises support lips at second pallet edge 106 that is opposite first pallet edge 104. Pallet 100 may comprise any number of support lips extending away from second pallet edge 106 and along the z-axis. In one specific configuration, pallet 100 comprises a same number of support lips extending away from second pallet edge 106 as those extending away from first pallet edge 104.

Among the support lips extending away from second pallet edge 106, pallet 100 is shown comprising third support lip 110A and fourth support lip 110B. Each of third support lip 110A and fourth support lip 110B extends upward and away from load supporting surface 102. That is, upward and away from load supporting surface 102 along the y-axis. Each of third support lip 110A and fourth support lip 110B extends in a direction from second pallet edge 106 toward first pallet edge 104.

Figure 2A:
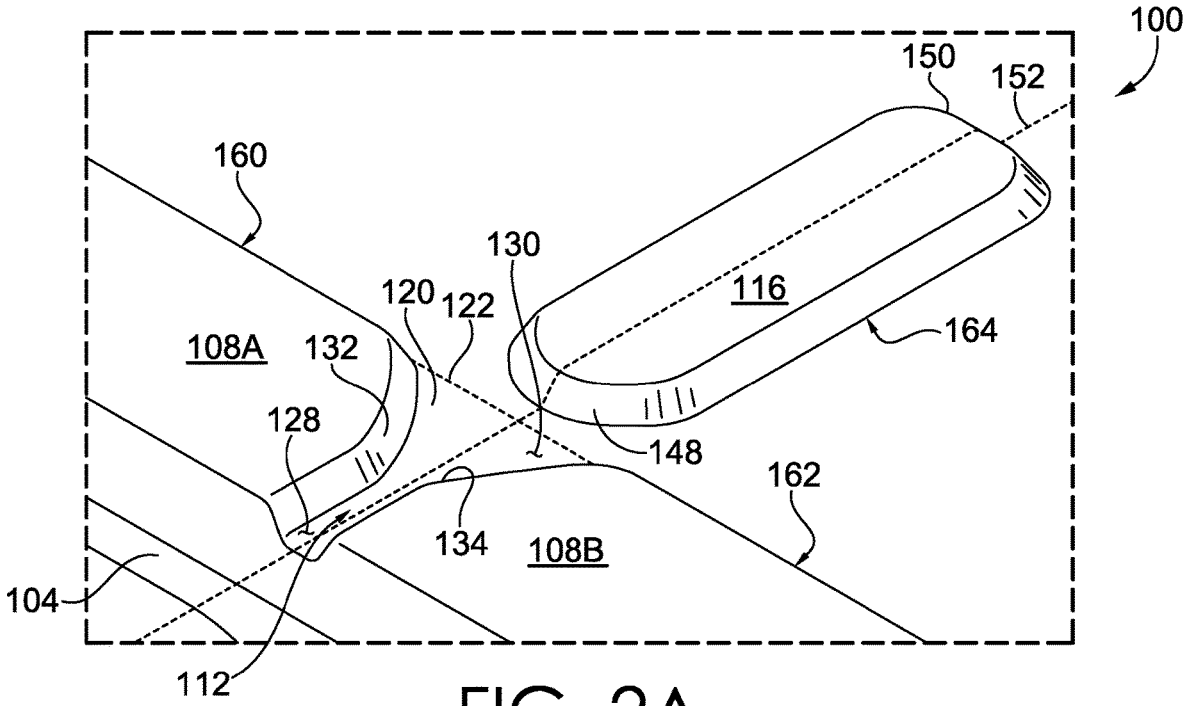
FIGS. 2A and 2B are enlarged views of areas of the pallet illustrated in FIG. 1, in accordance with aspects described herein.
Figure 2B:
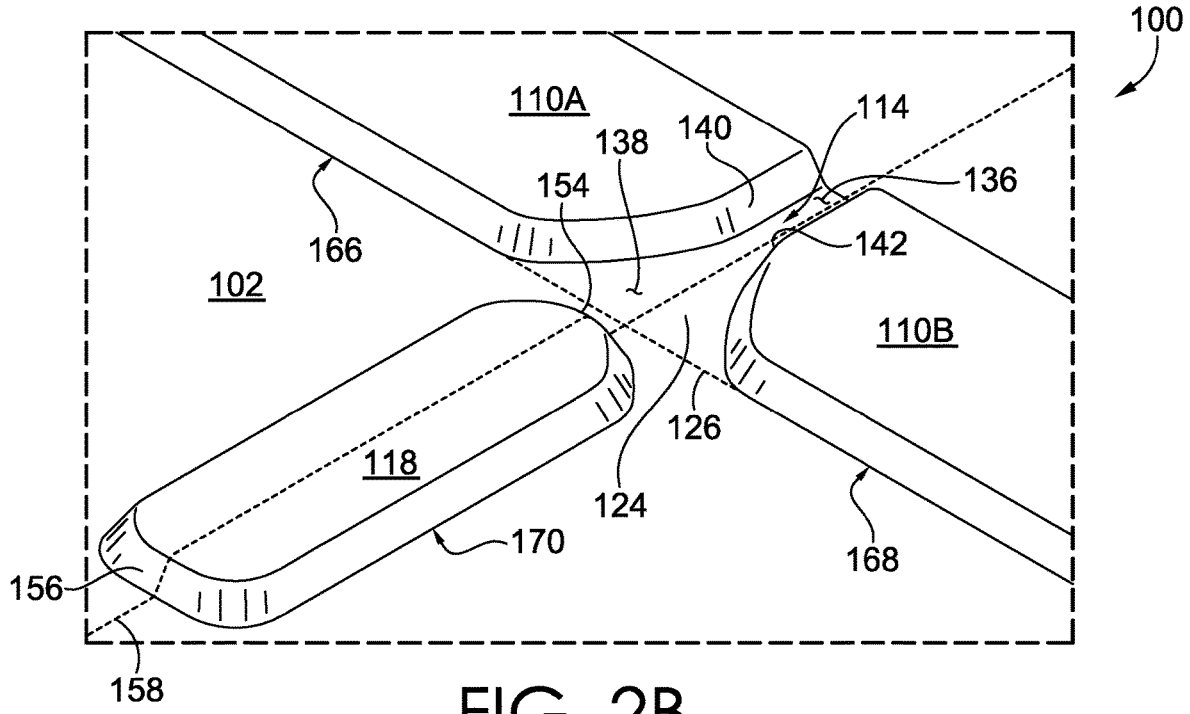

Continuing with FIG. 1, and as further shown and described with respect to FIGS. 2A and 2B, first support lip 108A is separated from second support lip 108B. Said differently, first support lip 108A and second support lip 108B comprise first support lip perimeter edge 160 and second support lip perimeter edge 162, respectively. First support lip perimeter edge 160 of first support lip 108A and second support lip perimeter edge 162 of second support lip 108B are separated. In this way, there is a first separation formed between first support lip 108A and second support lip 108B.

Likewise, third support lip 110A may also be separated from fourth support lip 110B. Third support lip 110A may have third support lip perimeter edge 166, while fourth support lip 110B may have fourth support lip perimeter edge 168, where third support lip perimeter edge 166 is separated from fourth support lip perimeter edge 168. As such, a second separation is formed between third support lip perimeter edge 166 and the fourth support lip perimeter edge 168.

The first separation between first support lip 108A and second support lip 108B forms first channel 112. It will be realized that, since pallet 100 can comprise any number of support lips, pallet 100 can also comprise any number of channels. As shown in FIG. 1, first channel 112 extends in a direction from first pallet edge 104 toward second pallet edge 106.

Similarly, the second separation between third support lip 110A and fourth support lip 110B forms second channel 114. Second channel 114 extends in a direction from second pallet edge 106 toward first pallet edge 104.

In some aspects, pallet 100 comprises one or more optical registration marks, such as optical registration mark 115. Optical registration mark 115 generally comprises any object that can be recognized by an optical recognition device, such as those employing cameras and utilizing image recognition software. In an aspect, optical registration mark 115 comprises a polymer, such as any of those described herein, and may comprise a different color of the same polymer used in forming pallet 100. This is beneficial because the optical registration mark also comprises a food-grade material and may be subject to washing or cleaning cycles without damage or degradation; while at the same time, the different color allows the optical recognition device to identify optical registration mark 115 against the pallet 100. In an alternative embodiment, optical registration mark 115 comprises a different material than pallet 100 and is a different color than pallet 100.

As illustrated, optical registration mark 115 is disposed on load supporting surface. In this example, optical registration mark 115 is further disposed within second stacking section 146. In this way, when a mold is placed within second stacking section 146, the mold covers optical registration mark from view of the optical recognition device. As such, the optical recognition device facilitates determination of whether a mold is present in second stacking section 146. In practice, optical registration mark 115 can also be used to align a mold within second stacking section 146.

In some aspects, optical registration mark 115 is planar with respect to load supporting surface 102. This allows molds to more easily be placed on and removed from load supporting surface 102. This also helps to not impede water flow during a cleaning process, and at this same time, provides a hygienic surface, as there is no place for water or other debris to collect.

With reference now to FIGS. 2A and 2B, the figures illustrate enlarged views of areas of pallet 100 of FIG. 1. The enlarged views are now referenced to further describe the technology.

In particular, FIG. 2A is an enlarged view of an area of pallet 100 comprising first channel 112 and first section divider 116, while FIG. 2B is an enlarged view of another area of pallet 100 comprising second channel 114 and second section divider 118. First section divider 116 and second section divider 118 will be discussed in more detail.

As shown in FIG. 2A, first channel 112 is formed from the first separation of first support lip 108A and second support lip 108B. First base 120 of first channel 112 is formed from a first extension of load supporting surface 102. That is, a portion of load supporting surface 102 may extend between first support lip 108A and second support lip 108B at a location corresponding to the first separation. FIG. 2A illustrates first base 120 as the first extension of load supporting surface 102 using first theoretical dashed line 122. First theoretical dashed line 122 is a theoretical line, indicting there may or may not be a demarcation present at a location corresponding to it. Here, first theoretical dashed line 122 indicates first base 120 as being between first support lip 108A and second support lip 108B, and between a location corresponding to a portion of first support lip perimeter edge 160 of first support lip 108A and a portion of second support lip perimeter edge 162 of second support lip 108B opposite first pallet edge 104 as illustrated using first theoretical dashed line 122.

In some aspects, first base 120 is formed from a first planar extension of load supporting surface 102. What is meant by planar is that the portion of load supporting surface 102 extending between first support lip 108A and second support lip 108B and forming first base 120 of first channel 112 extends along a same plane as another portion of load supporting surface 102 that is not between first support lip 108A and second support lip 108B. In another arrangement, the first extension of load supporting surface 102 between first support lip 108A and second support lip 108B is non-planar, for instance, it curves away from a plane along which another portion of load supporting surface 102 that is not between first support lip 108A and second support lip 108B extends. Put differently, the first extension may curve along the y-axis, while another portion of load supporting surface 102 extends along the plane created by the x- and z-axes. The downward curve can further aid in fluid and debris removal during use and cleaning.

In general, channels can comprise channel openings to facilitate liquid and debris passing through the channels. As shown in FIG. 2A, first channel 112 comprises first channel opening 128. First channel opening 128 is coincident with first pallet edge 104. First channel opening 128 is an egress channel opening where liquid and debris generally exit first channel 112. First channel 112 also comprises second channel opening 130 opposite first channel opening 128 that corresponds to a location illustrated by first theoretical dashed line 122, e.g., a location between a portion of first support lip perimeter edge 160 of first support lip 108A and a portion of second support lip perimeter edge 162 of second support lip 108B opposite first pallet edge 104. Second channel opening 130 is an ingress channel opening where liquid and debris generally enter first channel 112. As illustrated, second channel opening 130 may be wider than first channel opening 128. This can help direct the flow of liquid from load supporting surface 102 and off first pallet edge 104 during cleaning or use of pallet 100.

First channel 112 comprises first sidewall 132 and second sidewall 134. First sidewall 132 may be formed of a portion of first support lip 108A, while second sidewall 134 may be formed of a portion of second support lip 108B.

In the example provided by pallet 100, first support lip 108A comprises a chamfered edge. The chamfered edge of first support lip 108A forms first sidewall 132 of first channel 112. Second support lip 108B is illustrated as comprising a second chamfered edge, where the second chamfered edge of second support lip 108B forms second sidewall 134 of first channel 112. The chamfered edges help facilitate the removal of liquid and debris by diverting the liquid or debris into the channel.

Referencing FIG. 2B, second channel 114 is formed from the second separation of third support lip 110A and fourth support lip 110B. Second base 124 of second channel 114 is formed from a second extension of load supporting surface 102. That is, a portion of load supporting surface 102 may extend between third support lip 110A and fourth support lip 110B at a location corresponding to the second separation. FIG. 2B illustrates second base 124 as the second extension of load supporting surface 102 using second theoretical dashed line 126. Second theoretical dashed line 126 indicates second base 124 as being between third support lip 110A and fourth support lip 110B, and between a location corresponding to a portion of third support lip perimeter edge 166 of third support lip 110A and a portion of fourth support lip perimeter edge 168 of fourth support lip 110B opposite second pallet edge 106. Similarly, second base 124 may be a second planar extension of load supporting surface 102, or may be non-planar relative to a plane through which a portion of load supporting surface 102 that is not between third support lip 110A and fourth support lip 110B extends.

FIG. 2B is illustrated comprising second channel 114, where second channel 114 comprises third channel opening 136 and fourth channel opening 138. Third channel opening 136 coincident with second pallet edge 106. Third channel opening 136 is an egress channel opening where liquid and debris generally exit second channel 114. Fourth channel opening 138 is opposite third channel opening 136 and corresponds to a location illustrated by second theoretical dashed line 126, e.g., a location between a portion of third support lip perimeter edge 166 of third support lip 110A and a portion of fourth support lip perimeter edge 168 of fourth support lip 110B opposite second pallet edge 106. Fourth channel opening 138 is an ingress channel opening where liquid and debris generally enter second channel 114. As illustrated, fourth channel opening 138 may be wider than third channel opening 136 to help direct the flow of liquid off second pallet edge 106.

Second channel 114 comprises third sidewall 140 and fourth sidewall 142. Third sidewall 140 may be formed of a portion of third support lip 110A while fourth sidewall 142 may be formed of a portion of fourth support lip 110B.

Third support lip 110A can comprise a chamfered edge. The chamfered edge of third support lip 110A forms third sidewall 140 of second channel 114. Fourth support lip 110B is also illustrated as comprising a chamfered edge, and the chamfered edge of fourth support lip 110B forms fourth sidewall 142 of second channel 114. The chamfered edges of third support lip 110A and fourth support lip 110B help facilitate the removal of debris and fluid through second channel 114 during use or cleaning of pallet 100.

Turning back to FIG. 1, as illustrated, pallet 100 also comprises first section divider 116 and second section divider 118. In general, pallets may comprise any combination of section dividers and channels. Although pallet 100 has been shown having both channels formed from support lips and section dividers, it will be understood that any combination of section dividers and channels may be found on pallets, including pallets having section dividers or channels, or both. Further, like other features, it will be understood that a pallet may comprise any number of section dividers, and that section dividers can be found in any arrangement.

In general, section dividers divide stacking sections of a load supporting surface of a pallet. In doing so, section dividers assist in stabilizing molds or other objects within stacking sections during transportation. Section dividers can also assist with directing the flow of liquid and debris off the load supporting surface during use or during cleaning. For instance, section dividers can direct the flow of liquid or debris toward channels that facilitate moving the liquid or debris off the load supporting surface of the pallet.

One such arrangement of section dividers is illustrated in FIG. 1. Here, first section divider 116 and second section divider 118, both individually and together, at least partially define first stacking section 144 and second stacking section 146 as illustrated by dashed lines. Put another way, first section divider perimeter edge 164 of first section divider 116 or second section divider perimeter edge 170 of second section divider 118 can define a partial boundary of first stacking section 144 or second stacking section 146. By defining a stacking section, it is meant that section dividers, such as first section divider 116 and second section divider 118, may define all or a portion of a boundary of the stacking section in such a manner that the stacking section is configured to receive a mold.

As shown in FIG. 1, a portion of load supporting surface 102 can also be between first section divider 116 and second section divider 118. Thus, a portion of load supporting surface 102 can be positioned between and separate first section divider 116 and second section divider 118.

Likewise, stacking sections can also be at least partially defined by support lips. For example, first support lip 108A, first section divider 116, second section divider 118, and third support lip 110A define a partial boundary of first stacking section 144, while second support lip 108B, first section divider 116, second section divider 118, and fourth support lip 110B define a partial boundary of second stacking section 146.

Each of first stacking section 144 and second stacking section 146 can comprise a portion of load supporting surface 102. First stacking section 144 and second stacking section 146 are illustrated using dashed lines that represent theoretical boundaries. As illustrated, first section divider 116 and second section divider 118 can separate a first portion of load supporting surface 102 that corresponds to first stacking section 144 from a second portion of load supporting surface 102 that corresponds to second stacking section 146.

FIGS. 2A and 2B are also provided to illustrate some features of first section divider 116 and second section divider 118, respectively. Generally, section dividers may extend upward and away from a load supporting surface. As illustrated, first section divider 116 and second section divider 118 extend upward and away from load supporting surface 102.

First section divider 116 is illustrated as being spaced apart from and perpendicular to first pallet edge 104. That is, a long axis of first section divider 116 is oriented perpendicular to first pallet edge 104 and is further oriented perpendicular to a long axis of first support lip 108A and second support lip 108B.

In the aspect illustrated, first section divider 116 is positioned at second channel opening 130. As shown, first section divider 116 comprises first section divider end 148 that is opposite second section divider end 150 in the direction extending from first pallet edge 104 toward second pallet edge 106. First section divider 116 may have a length that is relatively greater than a width when measuring the length from first section divider end 148 to second section divider end 150. Said differently, the length measured along the z-axis is greater than the width measured along the x-axis. By having a greater length than width, and being positioned perpendicular to first pallet edge 104, first section divider 116 facilitates the removal of liquid and debris by directing the liquid and debris through second channel opening 130, while at the same time, increasing the surface area of load supporting surface 102 that can be utilized as a stacking section.

First section divider 116 comprises a first section divider midline that extends from first section divider end 148 to second section divider end 150. The first section divider midline may be about equidistant the width of first section divider 116. In FIG. 2A, the first section divider midline of first section divider 116 is represented using third theoretical dashed line 152 that is drawn extending through first section divider end 148, along the first section divider midline, and through second section divider end 150.

Further, first channel 112 comprises a first channel midline. The first channel midline may be about equidistant between first sidewall 132 and second sidewall 134 of first channel 112. As illustrated, third theoretical dashed line 152 is also shown extending through the first channel midline of first channel 112. Put another way, first section divider 116 can be positioned such that the first section divider midline of first section divider 116 is aligned with the first channel midline of first channel 112. The positioning of first section divider 116 in this manner helps facilitate the removal of fluid and debris from load supporting surface 102 regardless of the direction of movement.

Pallet 100 also comprises second section divider 118. In general, second section divider 118, illustrated in FIG. 2B, is spaced apart from and perpendicular to second pallet edge 106 and may be positioned at fourth channel opening 138. A long axis of second section divider 118 is oriented perpendicular to second pallet edge 106 and is further oriented perpendicular to a long axis of third support lip 110A and second support lip 110B.

Second section divider 118 comprises third section divider end 154 that is opposite fourth section divider end 156 in the direction extending from second pallet edge 106 toward first pallet edge 104. Second section divider 118 may have a length along the z-axis that is relatively greater than a width along the x-axis, e.g., when measuring the length from third section divider end 154 to fourth section divider end 156, thus helping facilitate removal of liquid and debris through fourth channel opening 138.

Second section divider 118 comprises a second section divider midline that extends from third section divider end 154 to fourth section divider end 156. The second section divider midline may be about equidistant the width of second section divider 118. In FIG. 2B, the second section divider midline of second section divider 118 is represented using fourth theoretical dashed line 158 that is drawn extending through third section divider end 154, along the second section divider midline, and through fourth section divider end 156.

Further, second channel 114 comprises a second channel midline. The second channel midline may be about equidistant between third sidewall 140 and fourth sidewall 142 of second channel 114. As illustrated, fourth theoretical dashed line 158 is also shown extending through the second channel midline of second channel 114. Second section divider 118 may be positioned such that the second section divider midline of second section divider 118 is aligned with the second channel midline of second channel 114.

In some aspects of the technology, section dividers may be positioned on opposite ends of the pallet. As illustrated by pallet 100 in FIG. 1, first section divider 116 is positioned relatively closer to first pallet edge 104 than second pallet edge 106, while second section divider 118 is positioned relatively closer to second pallet edge 106 than first pallet edge 104. Moreover, first section divider 116 may be positioned opposite and aligned with second section divider 118. That is, the first section divider midline of first section divider 116 may be aligned with the second section divider midline of second section divider 118.

Figure 3:
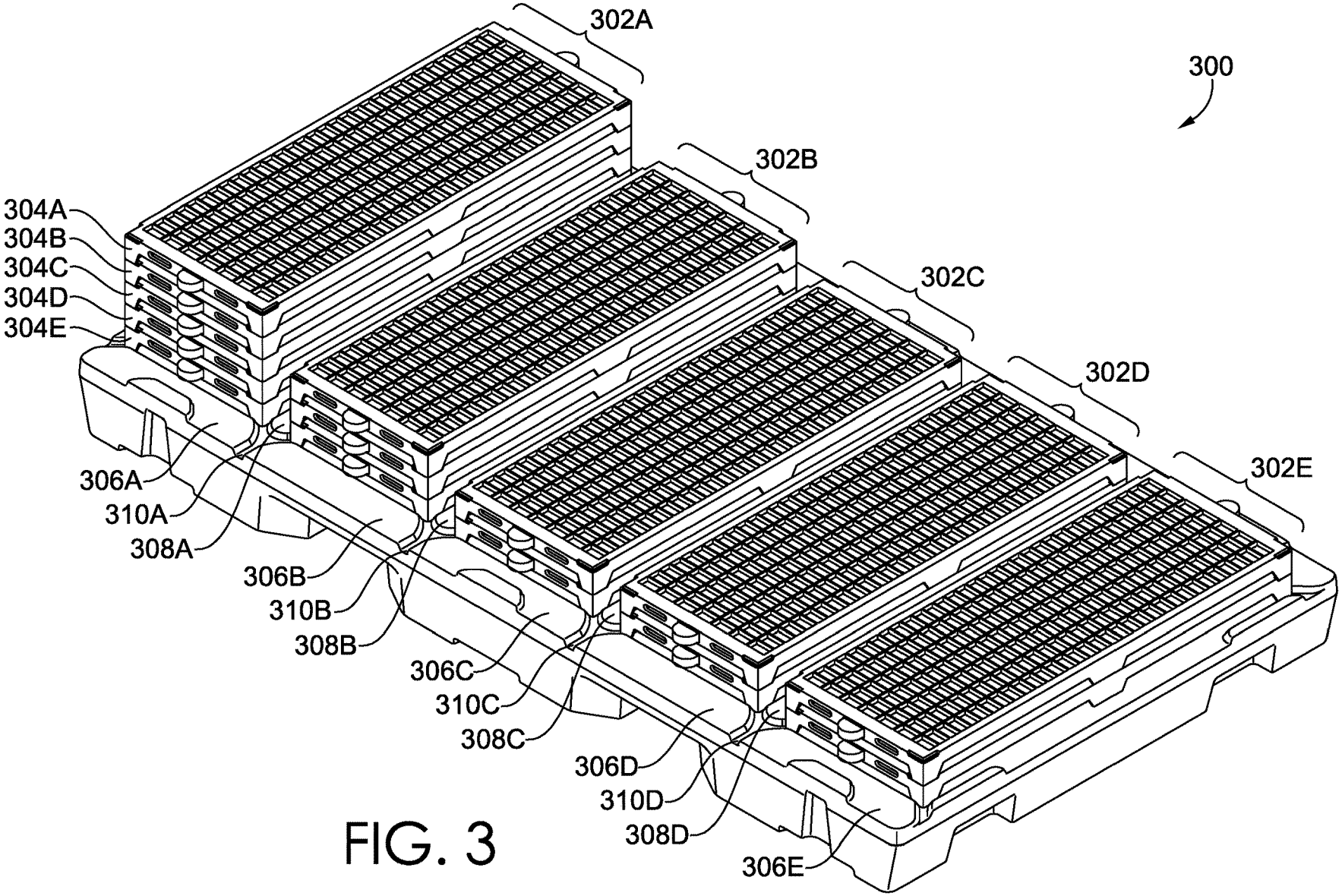
FIG. 3 is a top perspective view of another example pallet having molds stacked thereon, in accordance with an aspect described herein.

Turning briefly to FIG. 3, a top perspective view of another example pallet 300 is provided. Any of the pallets described, including pallet 100 of FIG. 1, is suitable for use as pallet 300. Pallet 300 comprises a plurality of stacking sections 302A-302E having a set of one or more molds stacked thereon. As an example, pallet 300 has molds 304A-304E stacked within first stacking section 302A, and it will be understood that any number of molds may be stacked onto the first stacking section 302A. In this particular example, a base mold is represented as mold 304E, and the base mold has been placed directly onto a portion of a load supporting surface of pallet 300 that corresponds to first stacking section 302A. Molds 304A-304D are stacked onto the base mold.

As described, stacking sections can be at least partially defined by support lips and section dividers. To illustrate using pallet 300, first support lip 306A and first section divider 308A each partially define first stacking section 302A. First section divider 308A, along with second support lip 306B and second section divider 308B, each partially define second stacking section 302B. Likewise, third stacking section 302C is partially defined by second section divider 308B, third support lip 306C, and third section divider 308C. Fourth stacking section 302D is partially defined by third section divider 308C, fourth support lip 306D, and fourth section divider 308D. Fifth stacking section 302E is partially defined by fourth section divider 308D and fifth support lip 306E. As noted, there may be other components of pallet 300 not shown that also define partial boundaries of stacking sections 302A-302E, such as additional support lips and section dividers on an opposite side of pallet 300.

Moreover, pallet 300 also comprises channels 310A-310D. Each of channels 310A-310D is formed from a separation between support lips 306A-306E and is positioned at a location between each of stacking sections 302A-302E. As previously described, channels 310A-310D facilitate the removal of fluid and debris that might be on the load supporting surface of pallet 300 during use or cleaning.

Figure 4:
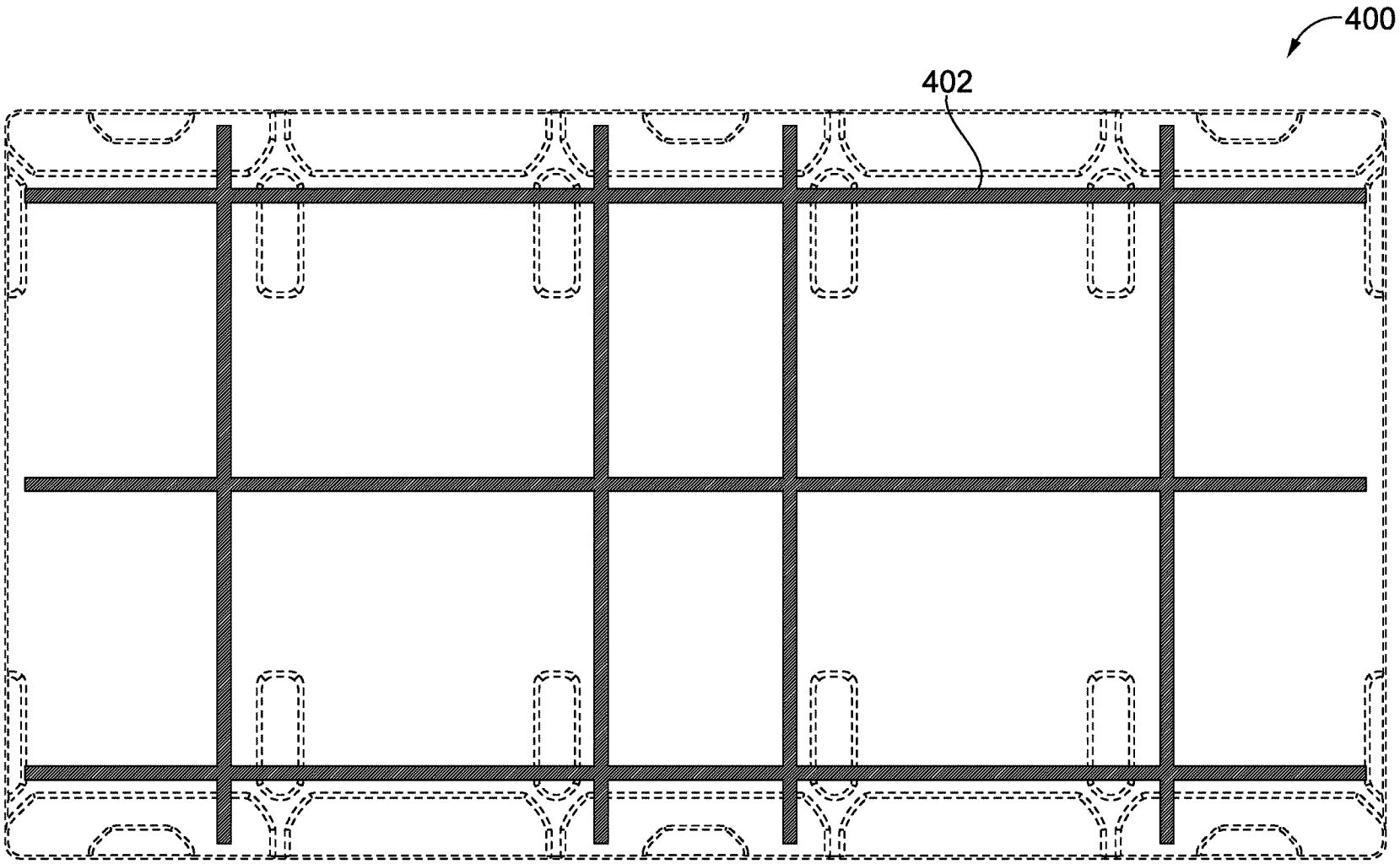
FIG. 4 is a top view of another pallet having an example internal frame, in accordance with an aspect described herein.

Referencing now FIG. 4, a top view of pallet 400 is provided. Pallet 400 has been shown in dashed lines to illustrate internal frame 402. Internal frame 402 provides pallet 400 with additional structural support, allowing it to carry heavy loads, while also reducing overall weight when compared to traditional pallet designs. Internal frame 402 may be a rigid frame. Some example materials suitable for use include metals, such iron, aluminum, chromium, nickel, titanium, and alloys thereof, such as steel, including galvanized stainless steel, and the like. Other rigid non-metal materials, such as carbon fiber and the like, may be used. While illustrated with respect to pallet 400, it will be understood that internal frame 402 is suitable for use with any of the pallets provided in this disclosure.

Figure 5:
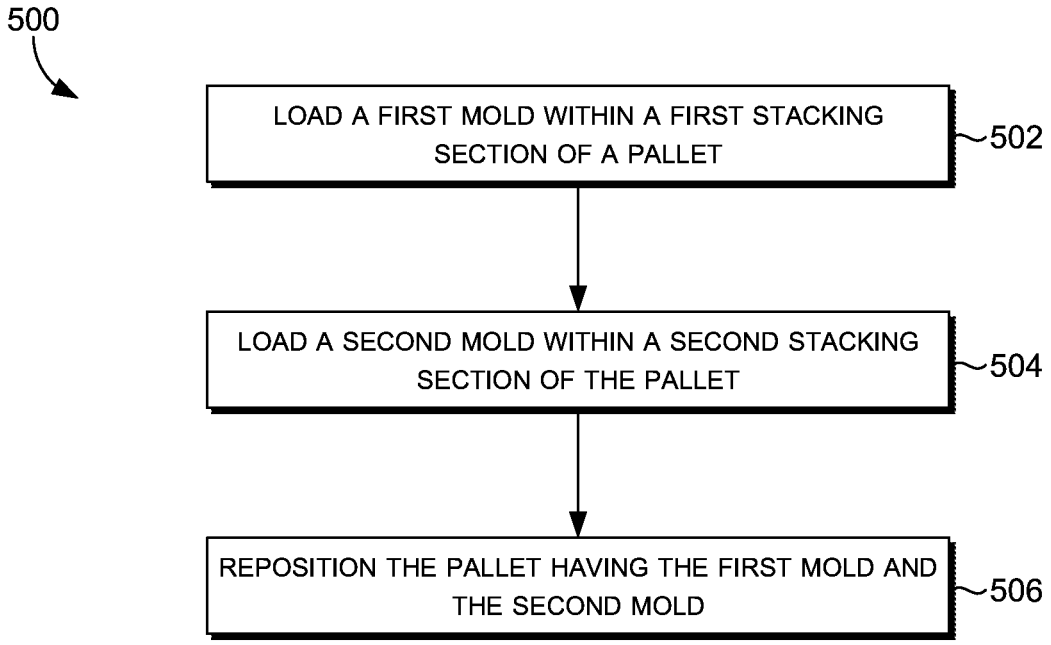
FIG. 5 is an example method of using a pallet, in accordance with an aspect described herein.

As described, pallets may be used to transport molds or other objects. FIG. 5 provides a block diagram of an example method of using a pallet, such as pallet 100 of FIG. 1 or any other described pallets. At block 502, a first mold is loaded onto a first stacking section of a load supporting surface of a pallet. The first mold may be included within a first set of one or more stackable molds loaded onto the first stacking area, and the first mold may represent a base mold having molds of the set of molds stacked thereon. The first mold may be stacked first, and then additional molds of the set of molds can be stacked onto the first mold. In another case, the set of molds can be stacked within the first stacking section simultaneously.

At block 504, a second mold is loaded onto a second stacking section of the load supporting surface, where the first stacking section and the second stacking section are separated by and at least partially defined by a section divider. Similarly, the second mold can be a base mold within the second stacking section and have other molds of a second set of molds stacked thereon. This may be done by stacking molds onto the base mold, or placing the second set of molds and the base mold within the second stacking section simultaneously.

At block 506, the pallet having the first mold and the second mold loaded thereon is repositioned from a first location to a second location.

In addition to transporting the first mold and the second mold, the method may include washing the pallet. The pallet may be washed after having removed the first mold and the second mold. Washing the pallet can include spraying the pallet with a liquid cleaning agent. The liquid and any debris on the pallet is removed from the pallet through the channels.

Figure 6:
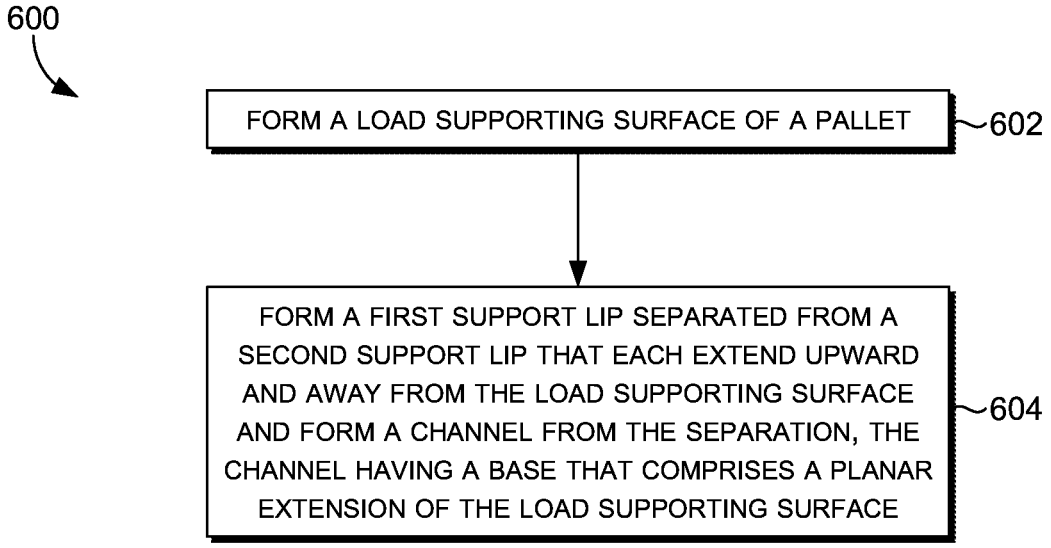
FIG. 6 is an example method of manufacturing a pallet, in accordance with an aspect described herein.

FIG. 6 is a block diagram of an example method of manufacturing a hygienic pallet, such as any of the pallets previously discussed, including pallet 100 of FIG. 1. At block 602, a load supporting surface of the pallet extending from a first pallet edge to a second pallet edge is formed. At block 604, a first support lip and a second support lip of the pallet are formed such that the first support lip is separated from the second support lip, and the separation of the first support lip and the second support lip forms a channel. Each of the first support lip and the second support lip is formed so that it extends upward and away from the load supporting surface, and each may extend from the first pallet edge toward the second pallet edge. The channel formed by the separation of the first support lip and the second support lip can be formed such that it comprises a base that is an extension, such as a planar extension, of the load supporting surface.

In an aspect, the first support lip and the second support lip can be formed such that each of the first support lip and the second support lip comprises a chamfered edge that forms a sidewall of the channel.

The method may also comprise forming a first section divider that extends upward and away from the load supporting surface, the first section divider being spaced apart from and perpendicular to the first pallet edge and the second pallet edge. In a more specific aspect, in forming the first section divider, the first section divider is positioned such that a section divider midline is aligned with a channel midline.

Moreover, the method may also comprise forming a second section divider having a second section divider midline extending upward and away from the load supporting surface, and the first section divider midline can be aligned with the second section divider midline.

In general, the components of the pallet, including the load supporting surface, support lips, and section dividers, can be formed of a polymer material. The polymer material may be a food-grade material. In one example, the polymer material is polyethylene, such as high-density polyethylene (HDPE) or polyethylene terephthalate (PET), or another like food-grade polymer. In some cases, non-polymer food-grade materials can be used, such as some metals, including stainless steel.

The components of the pallet may be formed of a material that does not comprise polynuclear aromatic hydrocarbons (PAHs). The material may not comprise latex or natural rubber. The material may not comprise phthalate esters or adipates. The material may not comprise bisphenol A, F, or S. The material may not comprise naphthalene or methylnaphthalene.

When using polymers, including polyethylene, the polymer can be spun, molded, milled, or the like to form the components of the pallet. For instance, polyethylene can be spun onto an internal rigid frame, such as the frame described with respect to pallet 400 and FIG. 4, to form the components. Milling may be used, including mechanical milling or another like device, including laser and heat removal methods, to form the components. The method may include forming the rigid frame by assembling a rigid material into a lattice.

One specific method suitable for forming the pallet comprises rotational molding. Using this method, a pallet is rotationally molded around a rigid frame using a pallet mold. A pallet mold can be formed having features corresponding to the features described and illustrated by FIG. 1, such as a load supporting surface, support lips and channels, section dividers, and so forth. When forming pallets comprising optical registration marks, a void can be milled into the pallet mold at a location corresponding to the location of the optical registration mark on a formed pallet. In another aspect, the pallet mold can be formed to comprise a projected area at a location corresponding to the location of the optical registration mark on the formed pallet. Thus, when a pallet is molded from the pallet mold, the pallet also comprises a void or recessed area around which the polymer material is deposited and at which an optically recognizable material, such as a material comprising a different color than that of the formed pallet, can be inserted into the void or recessed area on the pallet, thus forming an optical registration mark on the pallet that can be detected using an optical recognition device.

One example method suitable for forming a pallet mold comprises milling aluminum, or other rigid material, into a shape having features corresponding to the pallet formed by the pallet mold. Milled aluminum is particularly beneficial because it provides a lightweight metal that can be heated during the rotational molding process, and from which a molded polymer material can be easily removed. The pallet mold may be configured to support a rigid frame that is encased by the polymer during the rotational molding process.

The pallet mold and a polymer material can be heated within an oven as the pallet mold is being rotated so that the polymer material is distributed around the pallet mold and around the rigid frame. As the polymer material is cooled, it cures or otherwise solidifies to form the pallet. In this way, the rotational molding process forms the pallet within the pallet mold, and because the pallet mold supports the rigid frame, the resulting pallet encases the rigid frame. The pallet is then removed from the pallet mold, and the process can be repeated to form another pallet.

Rotational molding has been found to provide additional benefits over some other known molding methods, such as injection molding or three-dimensional printing. The rotational molding process tends to produce a molded polymer pallet that is more pliable relative to other methods, even when the same polymer material is used. This allows the pallet produced by the rotational molding process to support larger loads and to be subjected to a higher degree of environmental stresses before material fractures or other structural failures occur. Further, the rotational molding process reduces the amount of polymer material used during the molding process without compromising the strength of the molded pallet.

The load supporting surface may be sandblasted or polished. After forming the load supporting surface, the load supporting surface can be polished with at least a 120 grit material. This can enhance the flow of debris or fluid across the load supporting surface and through the channels of the pallet due to the smooth texture created by the polishing.

Any combination of the components may be formed as integral pieces. That is, one component may be formed of the same material and have no physical delineation from another component, but rather, is provided as one integral monolithic piece. For instance, a support lip or section divider may extend from a load supporting surface as one integral piece of material. In other cases, the components, such as the support lips and the section dividers, may be formed separately from the load supporting surface of the pallet and coupled to the load supporting surface, for instance, by welding, gluing, or using another like bonding method.

The subject matter of the present technology is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies.

Moreover, although the terms "step" or "block" might be used herein to connote different elements of methods employed, the terms should not be interpreted as implying any particular order unless indicated or stated otherwise.

Words such as "a" and "an," unless otherwise indicated to the contrary, include the plural as well as the singular. Thus, for example, the constraint of "a feature" is satisfied where one or more features are present. Furthermore, the term "or" includes the conjunctive, the disjunctive, and both (a or b thus includes either a or b, as well as a and b).

The term "about," when used in the context of approximation, can be interpreted as ±10% unless otherwise indicated. For example, the phrase "about 2.0" could be interpreted as a range equal to or between 1.8 and 2.2.

The relative terms "parallel" and "perpendicular" are intended to mean a relative angular difference of 0° (degrees) and 90°, respectively. However, it will be understood that, in part due to manufacturing tolerances and other design tolerance, such terms should be interpreted as "about parallel" and "about perpendicular," or about 0° (degrees) and about 90°.

From the foregoing, it will be seen that this technology is one well adapted to attain all the ends and objects described above, including other advantages that are obvious or inherent to the structure. It will be understood that certain features and subcombinations are of utility and may be employed without reference to other features and subcombinations. This is contemplated by and is within the scope of the claims. Since many possible embodiments of the described technology may be made without departing from the scope, it is to be understood that all matter described herein or illustrated the accompanying drawings is to be interpreted as illustrative and not in a limiting sense.

Some example aspects of the technology that may be practiced from the forgoing disclosure include the following. Any one of the following aspects may be combined in a multiple dependent manner to depend from one or more other aspects. Further, any combination of dependent aspects (aspects that explicitly depend from a previous aspect) may be combined while staying within the scope of the technology described herein. The following aspects are intended to be illustrative and not limiting.

Aspect 1: A hygienic pallet comprising: a load supporting surface extending from a first pallet edge to a second pallet edge, the first pallet edge being parallel to the second pallet edge; a first support lip and a second support lip, the first support lip and the second support lip each extending upward and away from the load supporting surface and extending in a direction from the first pallet edge toward the second pallet edge; and a first channel formed from a first separation between the first support lip and the second support lip, the first channel extending in the direction from the first pallet edge toward the second pallet edge, wherein a base of the first channel comprises a first planar extension of the load supporting surface.

Aspect 2: Aspect 1, wherein the first channel further comprises a first channel opening corresponding to the first pallet edge and a second channel opening opposite the first channel opening, the second channel opening being wider than the first channel opening.

Aspect 3: Any of Aspects 1-2, wherein the first support lip comprises a first chamfered edge that forms a first sidewall of the first channel and the second support lip comprises a second chamfered edge that forms a second sidewall of the first channel.

Aspect 4: Any of Aspects 1-3, further comprising: a third support lip and a fourth support lip, the third support lip and the fourth support lip each extending upward and away from the load supporting surface and extending in a direction from the second pallet edge toward the first pallet edge; and a second channel formed from a second separation between the third support lip and the fourth support lip, the second channel extending in the direction from the second pallet edge toward the first pallet edge, wherein a second base of the second channel comprises a second planar extension of the load supporting surface.

Aspect 5: Any of Aspects 1-4, further comprising a first section divider extending upward and away from the load supporting surface, the first section divider being spaced apart from and perpendicular to the first pallet edge and the second pallet edge.

Aspect 6: Any of Aspects 1-5, wherein a length of the first section divider, as measured from a first section divider end to a second section divider end of the first section divider in the direction extending from the first pallet edge to the second pallet edge, is greater than a width of the first section divider.

Aspect 7: Aspect 6, wherein a first section divider midline of the first section divider, extending from a first section divider end to a second section divider end of the first section divider, is aligned with a first channel midline of the first channel extending from a first channel opening to a second channel opening.

Aspect 8: Any of Aspects 6-7, further comprising a second section divider extending upward and away from the load supporting surface, the second section divider being spaced apart from and perpendicular to the first pallet edge and the second pallet edge, wherein a second section divider midline of the second section divider is aligned with a first section divider midline for the first section divider.

Aspect 9: Aspect 8, wherein the first section divider and the second section divider are separated by the load supporting surface.

Aspect 10: A method of manufacturing a hygienic pallet, the method comprising: forming a load supporting surface of a pallet such that the load supporting surface extends from a first pallet edge to a second pallet edge, the first pallet edge being parallel to the second pallet edge; and forming a first support lip and a second support lip of the pallet such that the first support lip is separated from the second support lip, each of the first support lip and the second support lip extending upward and away from the load supporting surface and extending in a direction from the first pallet edge toward the second pallet edge, wherein a first channel is formed from a first separation between the first support lip and the second support lip, the first channel extending in the direction from the first pallet edge toward the second pallet edge, and wherein a first base of the first channel comprises a first planar extension of the load supporting surface.

Aspect 11: Aspect 10, wherein the first support lip is formed such that the first support lip comprises a first chamfered edge that forms a first sidewall of the first channel and the second support lip is formed such that the second support lip comprises a second chamfered edge that forms a second sidewall of the first channel.

Aspect 12: Any of Aspects 10-11, further comprising forming a first section divider that extends upward and away from the load supporting surface, the first section divider being spaced apart from and perpendicular to the first pallet edge and the second pallet edge.

Aspect 13: Aspect 12, wherein the first section divider is formed such that a first section divider midline of the first section divider, extending from a first section divider end to a second section divider end of the first section divider, is aligned with a first channel midline of the first channel extending from a first channel opening to a second channel opening.

Aspect 14: Any of Aspects 12-13, further comprising forming a third support lip and a fourth support lip of the pallet, each of the third support lip and the fourth support lip extending upward and away from the load supporting surface and extending in a direction from the second pallet edge toward the first pallet edge, wherein a second channel is formed from a second separation between the third support lip and the fourth support lip, the second channel extending in the direction from the second pallet edge toward the first pallet edge, and wherein a second base of the second channel comprises a second planar extension of the load supporting surface.

Aspect 15: Any of Aspect 12-14, further comprising forming a second section divider such that the second section divider extends upward and away from the load supporting surface, the second section divider being spaced apart from and perpendicular to the first pallet edge and the second pallet edge, wherein a second section divider midline of the second section divider is aligned with a first section divider midline for the first section divider.

Aspect 16: Any of Aspects 10-15, further comprising forming a pallet mold, and rotationally molding the pallet around the pallet mold to form the load supporting surface, the first support lip, and the second support lip.

Aspect 17: A method of using a hygienic pallet, the method comprising: loading a first mold onto a load supporting surface of a pallet, the pallet comprising a first support lip and a second support lip that each extend upward and away from the load supporting surface and extend in a direction from a first pallet edge toward a second pallet edge opposite the first pallet edge, and comprising a third support lip and a fourth support lip that each extend upward and away from the load supporting surface and extend in a direction from the second pallet edge toward the first pallet edge, wherein a first separation between the first support lip and the second support lip forms a first channel extending in the direction from the first pallet edge toward the second pallet edge, the first channel comprising a first base that is a first planar extension of the load supporting surface, and wherein a second separation between the third support lip and the fourth support lip forms a second channel extending in the direction from the second pallet edge toward the first pallet edge, the second channel comprising a second base that is a second planar extension of the load supporting surface, the first mold being positioned within a first stacking section at least partially defined by the first support lip and the third support lip; loading a second mold onto the load supporting surface, the second mold being positioned within a second stacking section at least partially defined by the second support lip and the fourth support lip; and repositioning the pallet from a first location to a second location while the first mold and the second mold are loaded thereon.

Aspect 18: Aspect 17, wherein the first stacking section and the second stacking section are further defined by a section divider that extends upward and away from the load supporting surface, the section divider being spaced apart from and perpendicular to the first pallet edge and the second pallet edge.

Aspect 19: Any of Aspects 17-18, further comprising: stacking a first set of molds onto the first mold that is positioned within the first stacking section; and stacking a second set of molds onto the second mold that is positioned within the second stacking section.

Aspect 20: Any of Aspects 17-19, further comprising washing the pallet with a liquid, wherein the liquid is removed from the pallet through the first channel and the second channel.

What is claimed is:

1. A hygienic pallet comprising:

a load supporting surface extending from a first pallet edge to a second pallet edge, the first pallet edge being parallel to the second pallet edge;

a first support lip and a second support lip, the first support lip and the second support lip each extending upward and away from the load supporting surface and extending in a direction from the first pallet edge toward the second pallet edge, the first support lip having a first sidewall and the second support lip having a second sidewall; and a first channel formed from a first separation between the first support lip and the second support lip, the first channel extending in the direction from the first pallet edge toward the second pallet edge, and the first channel extending from the first sidewall to the second sidewall, wherein a base of the first channel comprises a first extension of the load supporting surface, wherein the first channel further comprises a first channel opening corresponding to the first pallet edge and a second channel opening opposite the first channel opening, the second channel opening being wider than the first channel opening.

2. The hygienic pallet of claim 1, wherein the first support lip comprises a first chamfered edge that forms at least a portion of the first sidewall of the first channel and the second support lip comprises a second chamfered edge that forms at least a portion of the second sidewall of the first channel.

3. The hygienic pallet of claim 1, further comprising:

a third support lip and a fourth support lip, the third support lip and the fourth support lip each extending upward and away from the load supporting surface and extending in a direction from the second pallet edge toward the first pallet edge, the third support lip having a third sidewall and the fourth support lip having a fourth sidewall; and a second channel formed from a second separation between the third support lip and the fourth support lip, the second channel extending in the direction from the second pallet edge toward the first pallet edge, and the second channel extending from the third sidewall to the fourth sidewall, wherein a second base of the second channel comprises a second extension of the load supporting surface.

4. The hygienic pallet of claim 1, further comprising a first section divider extending upward and away from the load supporting surface, the first section divider being spaced apart from and perpendicular to the first pallet edge and the second pallet edge, wherein a first section divider midline of the first section divider, extending from a first section divider end to a second section divider end of the first section divider, is aligned with a first channel midline of the first channel extending from the first channel opening to the second channel opening.

5. The hygienic pallet of claim 4, wherein a length of the first section divider, as measured from a first section divider end to a second section divider end of the first section divider in the direction extending from the first pallet edge to the second pallet edge, is greater than a width of the first section divider.

6. The hygienic pallet of claim 4, further comprising a second section divider extending upward and away from the load supporting surface, the second section divider being spaced apart from and perpendicular to the first pallet edge and the second pallet edge, wherein a second section divider midline of the second section divider is aligned with a first section divider midline for the first section divider.

7. The hygienic pallet of claim 6, wherein the first section divider and the second section divider are separated by the load supporting surface.

8. A method of manufacturing a hygienic pallet, the method comprising:

forming a load supporting surface of a pallet such that the load supporting surface extends from a first pallet edge to a second pallet edge, the first pallet edge being parallel to the second pallet edge; and forming a first support lip and a second support lip of the pallet such that the first support lip is separated from the second support lip, each of the first support lip and the second support lip extending upward and away from the load supporting surface and extending in a direction from the first pallet edge toward the second pallet edge, the first support lip having a first sidewall and the second support lip having a second sidewall, wherein a first channel is formed from a first separation between the first support lip and the second support lip, the first channel extending in the direction from the first pallet edge toward the second pallet edge, wherein the first channel comprises a first channel opening corresponding to the first pallet edge and a second channel opening opposite the first channel opening, the second channel opening being wider than the first channel opening, and the first channel extending from the first sidewall to the second sidewall, and wherein a first base of the first channel comprises a first extension of the load supporting surface.

9. The method of claim 8, wherein the first support lip is formed such that the first support lip comprises a first chamfered edge that forms at least a portion of the first sidewall of the first channel and the second support lip is formed such that the second support lip comprises a second chamfered edge that forms at least a portion of the second sidewall of the first channel.

10. The method of claim 8, further comprising forming a first section divider that extends upward and away from the load supporting surface, the first section divider being spaced apart from and perpendicular to the first pallet edge and the second pallet edge, wherein the first section divider is formed such that a first section divider midline of the first section divider, extending from a first section divider end to a second section divider end of the first section divider, is aligned with a first channel midline of the first channel extending from the first channel opening to the second channel opening.

11. The method of claim 10, further comprising forming a third support lip and a fourth support lip of the pallet, each of the third support lip and the fourth support lip extending upward and away from the load supporting surface and extending in a direction from the second pallet edge toward the first pallet edge, wherein a second channel is formed from a second separation between the third support lip and the fourth support lip, the second channel extending in the direction from the second pallet edge toward the first pallet edge, the third support lip having a third sidewall and the fourth support lip having a fourth sidewall, the second channel extending from the third sidewall to the fourth sidewall, and wherein a second base of the second channel comprises a second extension of the load supporting surface.

12. The method of claim 10, further comprising forming a second section divider such that the second section divider extends upward and away from the load supporting surface, the second section divider being spaced apart from and perpendicular to the first pallet edge and the second pallet edge, wherein a second section divider midline of the second section divider is aligned with a first section divider midline for the first section divider.

13. The method of claim 8, further comprising:

forming a pallet mold, and rotationally molding the pallet around the pallet mold to form the load supporting surface, the first support lip, and the second support lip.

14. The method of claim 8, wherein the first channel opening is coincident with the first pallet edge.

15. A method of using a hygienic pallet, the method comprising:

loading a first mold onto a load supporting surface of a pallet, the pallet comprising a first support lip and a second support lip that each extend upward and away from the load supporting surface and extend in a direction from a first pallet edge toward a second pallet edge opposite the first pallet edge, the first support lip having a first sidewall and the second support lip having a second sidewall, and comprising a third support lip and a fourth support lip that each extend upward and away from the load supporting surface and extend in a direction from the second pallet edge toward the first pallet edge, the third support lip having a third sidewall and the fourth support lip having a fourth sidewall, wherein a first separation between the first support lip and the second support lip forms a first channel extending in the direction from the first pallet edge toward the second pallet edge, the first channel comprising a first channel opening corresponding to the first pallet edge and a second channel opening opposite the first channel opening, the second channel opening being wider than the first channel opening, and the first channel extending from the first sidewall to the second sidewall, the first channel comprising a first base that is a first extension of the load supporting surface, and wherein a second separation between the third support lip and the fourth support lip forms a second channel extending in the direction from the second pallet edge toward the first pallet edge, and the second channel extending from the third sidewall to the fourth sidewall, the second channel comprising a second base that is a second extension of the load supporting surf ace, the first mold being positioned within a first stacking section at least partially defined by the first support lip and the third support lip;

loading a second mold onto the load supporting surface, the second mold being positioned within a second stacking section at least partially defined by the second support lip and the fourth support lip; and repositioning the pallet from a first location to a second location while the first mold and the second mold are loaded thereon.

16. The method of claim 15, wherein the first stacking section and the second stacking section are further defined by a section divider that extends upward and away from the load supporting surface, the section divider being spaced apart from and perpendicular to the first pallet edge and the second pallet edge, wherein a section divider midline of the section divider, extending from a first section divider end to a second section divider end of the section divider, is aligned with a first channel midline of the first channel extending from the first channel opening to the second channel opening.

17. The method of claim 15, further comprising:

stacking a first set of molds onto the first mold that is positioned within the first stacking section; and stacking a second set of molds onto the second mold that is positioned within the second stacking section.

18. The method of claim 15, further comprising washing the pallet with a liquid, wherein the liquid is removed from the pallet through the first channel and the second channel.

19. The hygienic pallet of claim 1, wherein the first channel opening is coincident with the first pallet edge.

* * * * *